US011994000B2

(12) United States Patent
Power et al.

(10) Patent No.: US 11,994,000 B2
(45) Date of Patent: May 28, 2024

(54) DISSOLVABLE BRIDGE PLUGS

(71) Applicant: NexGen Oil Tools Inc., Three Rivers, TX (US)

(72) Inventors: Travis Jack Power, Houston, TX (US); Mark Wayne Mclelland, Houston, TX (US); Tuan A. Nguyen, Houston, TX (US)

(73) Assignee: NexGen Oil Tools Inc., Three Rivers, TX (US)

( * ) Notice: Subject to any disclaimer, the term of this patent is extended or adjusted under 35 U.S.C. 154(b) by 1 day.

(21) Appl. No.: 17/929,999

(22) Filed: Sep. 6, 2022

(65) Prior Publication Data

US 2022/0412186 A1 Dec. 29, 2022

Related U.S. Application Data

(62) Division of application No. 16/861,857, filed on Apr. 29, 2020, now Pat. No. 11,459,850.

(60) Provisional application No. 62/842,720, filed on May 3, 2019.

(51) Int. Cl.

| | |
|---|---|
| ***E21B 33/134*** | (2006.01) |
| ***E21B 23/01*** | (2006.01) |
| ***E21B 23/06*** | (2006.01) |
| ***E21B 33/128*** | (2006.01) |
| ***E21B 33/129*** | (2006.01) |

(52) U.S. Cl.
CPC ..... *E21B 33/134* (2013.01); *E21B 23/01* (2013.01); *E21B 23/06* (2013.01); *E21B 33/128* (2013.01); *E21B 33/1285* (2013.01); *E21B 33/129* (2013.01); *E21B 33/1293* (2013.01); *E21B 2200/08* (2020.05)

(58) Field of Classification Search
CPC ..... E21B 33/134; E21B 23/01; E21B 23/06; E21B 33/128; E21B 33/1285; E21B 33/129; E21B 33/1293; E21B 2200/08
See application file for complete search history.

(56) References Cited

U.S. PATENT DOCUMENTS

| | | | | |
|---|---|---|---|---|
| 9,574,415 | B2 * | 2/2017 | Xu | C22C 1/0416 |
| 2016/0160593 | A1 * | 6/2016 | Xu | E21B 33/124 166/382 |
| 2017/0268310 | A1 * | 9/2017 | Shkurti | E21B 33/1208 |
| 2019/0055810 | A1 * | 2/2019 | Fripp | A61K 47/34 |

* cited by examiner

*Primary Examiner* — D. Andrews
(74) *Attorney, Agent, or Firm* — Vorys, Sater, Seymour and Pease LLP

(57) ABSTRACT

A bridge plug includes a mandrel, a setting cone disposed at least partially about the mandrel, a slip ring and a sealing element disposed at least partially about the setting cone, and a guide shoe operatively coupled to a downhole end of the mandrel. The bridge plug is actuatable from a run-in state to a deployed state, wherein, when the bridge plug is in the deployed state, the mandrel is axially movable relative to the setting cone to seal or open a flow path through the bridge plug.

19 Claims, 8 Drawing Sheets

DISSOLVABLE BRIDGE PLUGS

BACKGROUND

In the oil and gas industry, wellbores are typically drilled in a near vertical orientation from the surface with a rotatory drilling rig. The rig utilizes a drill bit attached to drill pipe to penetrate the earth and a drilling mud system is operated to return cuttings to the surface. The drill bit may be steered with measure—while drilling (MWD) or rotary steering systems, as is common to the drilling industry. In some wellbores, a horizontal portion is drilled from the vertical portion to penetrate more surface area of a hydrocarbon-bearing formation. After drilling the wellbore, all or a portion of the wellbore may be lined with casing or a liner, which may be cemented in place to stabilize the wellbore and prevent corrosion of the casing or liner.

Prior to initiating hydrocarbon production, the casing or liner must be perforated and the surrounding formation may be hydraulically fractured or "fracked" to increase permeability of the surrounding subterranean formations. One common method to perforate and hydraulically fracture multiple zones in wellbore horizontal sections is referred to as a "plug and perf" hydraulic fracturing operation. In the "plug and perf" process, one or more perforating guns are lowered into the wellbore and selectively detonated to pierce the casing or liner, the cement, and the surrounding formation in a single shot. Once holes are formed through the casing or lining and the cement, the surrounding formations may then be hydraulically fractured through the formed holes.

Hydraulic fracturing entails pumping a viscous fracturing fluid downhole under high pressure and injecting the fracturing fluid into adjacent hydrocarbon-bearing formations to create, open, and extend formation fractures. Fracturing fluids usually contain propping agents, commonly referred to as "proppant," that flow into the fractures and hold or "prop" open the fractures once the fluid pressure is reduced. Propping the fractures open enhances permeability by allowing the fractures to serve as conduits for hydrocarbons trapped within the formation to flow to the wellbore.

Once a production zone has been hydraulically fractured, a wellbore isolation device, such as a bridge plug (alternately referred to as a "frac" plug), is typically positioned within the wellbore uphole from the treated production zone to isolate that zone. The operation then moves uphole and the process is repeated multiple times working from the toe of the well towards the heel.

Depending on the equipment utilized, the "plug and perf" method can be time consuming, but several innovations have been developed to speed up this multistage process. One innovation, for example, is manufacturing some or all of the component parts of wellbore isolation devices with dissolvable or degradable materials, which eliminates the need to drill up (or drill through) the wellbore isolation devices after the zones have been hydraulically fractured. More specifically, one or more of the body, the anchoring systems, and the sealing elements of wellbore isolation devices can be made of dissolvable or degradable materials. Consequently, dissolvable wellbore isolation devices provide a temporary plug that will dissolve or erode in the presence of a compatible catalyst (e.g., a fluid or chemical). However, these wellbore isolation devices have a limited amount of time of pressure integrity that is controllable with the alloy of the material, dual material castings, and coatings.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1A:
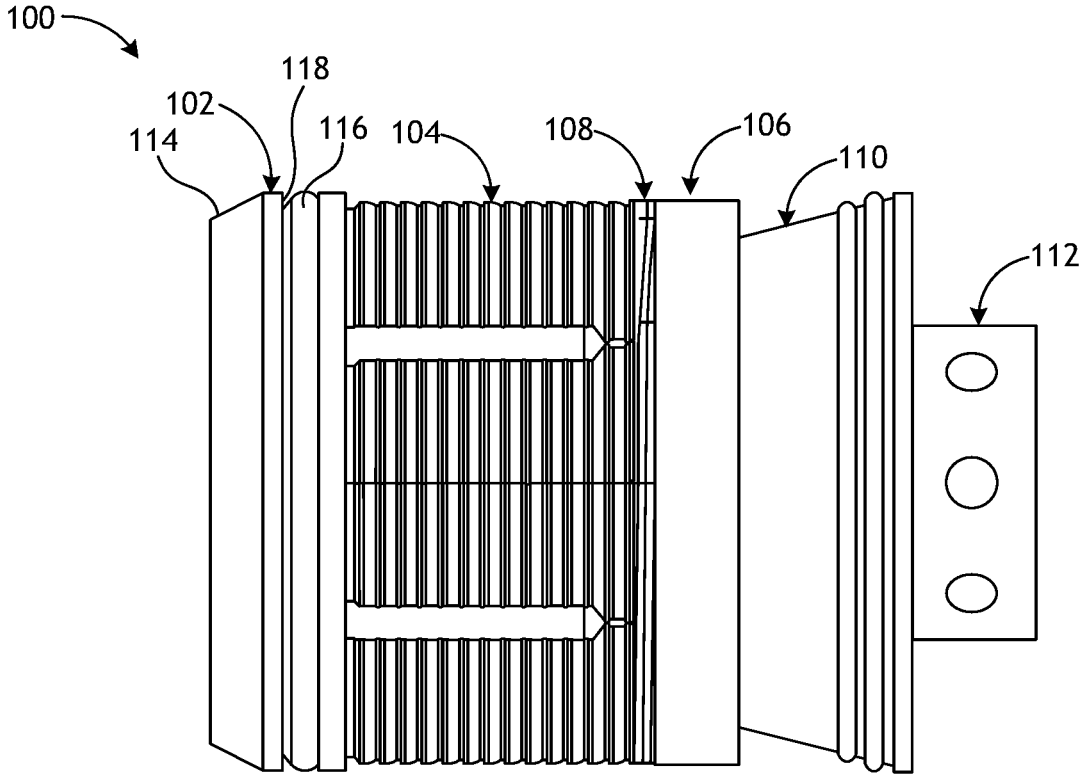
FIGS. 1A and 1B are side and exploded side views, respectively, of an example bridge plug 100 that may incorporate the principles of the present disclosure.

The present disclosure is related to downhole operations in the oil and gas industry and, more particularly, to dissolvable bridge plugs with a movable mandrel valve or a mandrel that forms a projectile seat.

The bridge plugs described herein may have some millable parts and some dissolvable parts for longer term life. The dissolvable parts of the bridge plugs may be made of or comprise a degradable or dissolvable material. The terms "degradable" and "dissolvable" will be used herein interchangeably. The term "degradable" and all of its grammatical variants (e.g., "degrade," "degradation," "degrading," and the like) refers to the dissolution or chemical conversion of materials into smaller components, intermediates, or end products by at least one of solubilization, hydrolytic degradation, biologically formed entities (e.g., bacteria or enzymes), chemical reactions (including electrochemical reactions), thermal reactions, or reactions induced by radiation. In some instances, the degradation of the material may be sufficient for the mechanical properties of the material to be reduced to a point that the material no longer maintains its integrity and, in essence, falls apart or sloughs off. The conditions for degradation or dissolution are generally wellbore conditions where an external stimulus may be used to initiate or effect the rate of degradation. For example, the pH of the fluid that interacts with the material may be changed by the introduction of an acid or a base.

The degradation rate of a given dissolvable material may be accelerated, rapid, or normal, as defined herein. Accelerated degradation may be in the range of from a lower limit of about 30 minutes, 1 hour, 2 hours, 3 hours, 4 hours, 5 hours, and 6 hours to an upper limit of about 12 hours, 11 hours, 10 hours, 9 hours, 8 hours, 7 hours, and 6 hours, encompassing any value or subset therebetween. Rapid degradation may be in the range of from a lower limit of about 12 hours, 1 day, 2 days, 3 days, 4 days, and 5 days to an upper limit of about 10 days, 9 days, 8 days, 7 days, 6 days, and 5 days, encompassing any value or subset therebetween. Normal degradation may be in the range of from a lower limit of about 10 days, 11 days, 12 days, 13 days, 14 days, 15 days, 16 days, 17 days, 18 days, 19 days, 20 days, 21 days, 22 days, 23 days, 24 days, 25 days, and 26 days to an upper limit of about 40 days, 39 days, 38 days, 37 days, 36 days, 35 days, 34 days, 33 days, 32 days, 31 days, 30 days, 29 days, 28 days, 27 days, and 26 days, encompassing any value or subset therebetween. Accordingly, degradation of the dissolvable material may be between about 30 minutes to about 40 days, depending on a number of factors including, but not limited to, the type of dissolvable material selected, the conditions of the wellbore environment, and the like.

Suitable dissolvable materials that may be used in accordance with the embodiments of the present disclosure include dissolvable metals, galvanically-corrodible metals, degradable polymers, a degradable rubber, borate glass, polyglycolic acid (PGA), polylactic acid (PLA), dehydrated salts, and any combination thereof. Suitable dissolvable materials may also include an epoxy resin exposed to a caustic solution, fiberglass exposed to an acid, aluminum exposed to an acidic fluid, and a binding agent exposed to a caustic or acidic solution. The dissolvable materials may be configured to degrade by a number of mechanisms including, but not limited to, swelling, dissolving, undergoing a chemical change, electrochemical reactions, undergoing thermal degradation, or any combination of the foregoing.

Degradation by swelling involves the absorption by the dissolvable material of aqueous or hydrocarbon fluids present within the wellbore environment such that the mechanical properties of the dissolvable material degrade or fail. In degradation by swelling, the dissolvable material continues to absorb the aqueous and/or hydrocarbon fluid until its mechanical properties are no longer capable of maintaining the integrity of the dissolvable material and it at least partially falls apart. In some embodiments, the dissolvable material may be designed to only partially degrade by swelling in order to ensure that the mechanical properties of the component formed from the dissolvable material is sufficiently capable of lasting for the duration of the specific operation in which it is utilized.

Example aqueous fluids that may be used to swell and degrade the dissolvable material include, but are not limited to, fresh water, saltwater (e.g., water containing one or more salts dissolved therein), brine (e.g., saturated salt water), seawater, acid, bases, or combinations thereof. Example hydrocarbon fluids that may swell and degrade the dissolvable material include, but are not limited to, crude oil, a fractional distillate of crude oil, a saturated hydrocarbon, an unsaturated hydrocarbon, a branched hydrocarbon, a cyclic hydrocarbon, and any combination thereof.

Degradation by dissolving involves a dissolvable material that is soluble or otherwise susceptible to an aqueous fluid or a hydrocarbon fluid, such that the aqueous or hydrocarbon fluid is not necessarily incorporated into the dissolvable material (as is the case with degradation by swelling), but becomes soluble upon contact with the aqueous or hydrocarbon fluid.

Degradation by undergoing a chemical change may involve breaking the bonds of the backbone of the dissolvable material (e.g., a polymer backbone) or causing the bonds of the dissolvable material to crosslink, such that the dissolvable material becomes brittle and breaks into small pieces upon contact with even small forces expected in the wellbore environment.

Thermal degradation of the dissolvable material involves a chemical decomposition due to heat, such as heat that may be present in a wellbore environment. Thermal degradation of some dissolvable materials mentioned or contemplated herein may occur at wellbore environment temperatures that exceed about 93° C. (or about 200° F.).

With respect to dissolvable or galvanically-corrodible metals used as a dissolvable material, the metal may be configured to degrade by dissolution in the presence of an aqueous fluid or via an electrochemical process in which a galvanically-corrodible metal corrodes in the presence of an electrolyte (e.g., brine or other salt-containing fluids). Suitable dissolvable or galvanically-corrodible metals include, but are not limited to, gold, gold-platinum alloys, silver, nickel, nickel-copper alloys, nickel-chromium alloys, copper, copper alloys (e.g., brass, bronze, etc.), chromium, tin, aluminum, iron, zinc, magnesium, and beryllium. Suitable galvanically-corrodible metals also include a nano-structured matrix galvanic materials. One example of a nano-structured matrix micro-galvanic material is a magnesium alloy with iron-coated inclusions. Suitable galvanically-corrodible metals also include micro-galvanic metals or materials, such as a solution-structured galvanic material. An example of a solution-structured galvanic material is zirconium (Zr) containing a magnesium (Mg) alloy, where different domains within the alloy contain different percentages of Zr. This leads to a galvanic coupling between these different domains, which causes micro-galvanic corrosion and degradation. Micro-galvanically corrodible magnesium alloys could also be solution structured with other elements such as zinc, aluminum, nickel, iron, carbon, tin, silver, copper, titanium, rare earth elements, et cetera. Micro-galvanically corrodible aluminum alloys could be in solution with elements such as nickel, iron, carbon, tin, silver, copper, titanium, gallium, et cetera. Of these galvanically-corrodible metals, magnesium and magnesium alloys may be preferred.

With respect to degradable polymers used as a dissolvable material, a polymer is considered "degradable" or "dissolvable" if the degradation is due to, in situ, a chemical and/or radical process such as hydrolysis, oxidation, or UV radiation. Degradable polymers, which may be either natural or synthetic polymers, include, but are not limited to, polyacrylics, polyamides, and polyolefins such as polyethylene, polypropylene, polyisobutylene, and polystyrene. Suitable examples of degradable polymers that may be used in accordance with the embodiments of the present invention include polysaccharides such as dextran or cellulose, chitins, chitosans, proteins, aliphatic polyesters, poly(lactides), poly(glycolides), poly(ε-caprolactones), poly(hydroxybutyrates), poly(anhydrides), aliphatic or aromatic polycarbonates, poly(orthoesters), poly(amino acids), poly(ethylene oxides), polyphosphazenes, poly(phenyllactides), polyepichlorohydrins, copolymers of ethylene oxide/polyepichlorohydrin, terpolymers of epichlorohydrin/ethylene oxide/allyl glycidyl ether, and any combination thereof.

Polyanhydrides are another type of particularly suitable degradable polymer useful in the embodiments of the present disclosure. Polyanhydrides hydrolyze in the presence of aqueous fluids to liberate the constituent monomers or comonomers, yielding carboxylic acids as the final degradation products. The erosion time can be varied over a broad range of changes to the polymer backbone, including varying the molecular weight, composition, or derivatization. Examples of suitable polyanhydrides include poly(adipic anhydride), poly(suberic anhydride), poly(sebacic anhydride), and poly(dodecanedioic anhydride). Other suitable examples include, but are not limited to, poly(maleic anhydride) and poly(benzoic anhydride).

Suitable degradable rubbers include degradable natural rubbers (i.e., cis-1,4-polyisoprene) and degradable synthetic rubbers, which may include, but are not limited to, ethylene propylene diene M-class rubber, isoprene rubber, isobutylene rubber, polyisobutene rubber, styrene-butadiene rubber, silicone rubber, ethylene propylene rubber, butyl rubber, norbornene rubber, polynorbornene rubber, a block polymer of styrene, a block polymer of styrene and butadiene, a block polymer of styrene and isoprene, and any combination thereof. Other suitable degradable polymers include those that have a melting point that is such that it will dissolve at the temperature of the subterranean formation in which it is placed.

In some embodiments, the dissolvable material may have a thermoplastic polymer embedded therein. The thermoplastic polymer may modify the strength, resiliency, or modulus of the component and may also control the degradation rate of the component. Suitable thermoplastic polymers may include, but are not limited to, an acrylate (e.g., polymethylmethacrylate, polyoxymethylene, a polyamide, a polyolefin, an aliphatic polyamide, polybutylene terephthalate, polyethylene terephthalate, polycarbonate, polyester, polyethylene, polyetheretherketone, polypropylene, polystyrene, polyvinylidene chloride, styrene-acrylonitrile), polyurethane prepolymer, polystyrene, poly(o-methylstyrene), poly (m-methylstyrene), poly(p-methylstyrene), poly(2,4-dimethylstyrene), poly(2,5-dimethylstyrene), poly(p-tert-butylstyrene), poly(p-chlorostyrene), poly(α-methylstyrene), co- and ter-polymers of polystyrene, acrylic resin, cellulosic resin, polyvinyl toluene, and any combination thereof. Each of the foregoing may further comprise acrylonitrile, vinyl toluene, or methyl methacrylate. The amount of thermoplastic polymer that may be embedded in the dissolvable material forming the component may be any amount that confers a desirable elasticity without affecting the desired amount of degradation. In some embodiments, the thermoplastic polymer may be included in an amount in the range of a lower limit of about 1%, 5%, 10%, 15%, 20%, 25%, 30%, 35%, 40%, and 45% to an upper limit of about 91%, 85%, 80%, 75%, 70%, 65%, 60%, 55%, 50%, and 45% by weight of the dissolvable material, encompassing any value or subset therebetween.

Figure 1B:
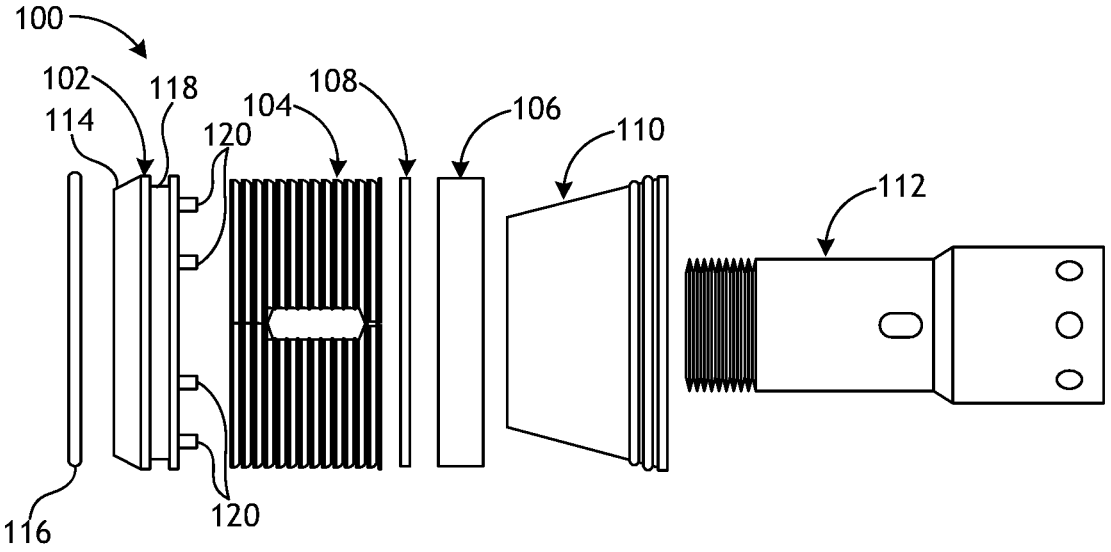

FIGS. 1A and 1B are side and exploded side views, respectively, of an example bridge plug 100 that may incorporate the principles of the present disclosure. The bridge plug 100, alternately referred to as a "frac plug," has one or more dissolvable component parts and is configured to anchor itself to casing or liner that lines the inner wall of a wellbore. As described herein, the bridge plug 100 may incorporate or otherwise include a closable flow path designed to allow flow from below (i.e., downhole), but prevent flow from above (i.e., uphole), and may thus operate as a temporary one-way check valve.

As illustrated, the bridge plug 100 may include a guide shoe 102, a slip ring 104, a sealing element 106, an element backup ring 108, a setting cone 110, and a mandrel 112. Some or all of the foregoing parts may be made of any of the dissolvable materials mentioned herein and otherwise degradable upon coming into contact with specific solvents. The individual parts of the bridge plug 100 may dissolve at the same rate or at different rates by design. Some of the parts may be manufactured with two or more dissolvable alloys, which allows the alloy located along the outside (e.g., further from the centerline of the bridge plug 100) to dissolve slowly and the alloy located inside (e.g., closer to the centerline of the bridge plug 100) to dissolve more quickly, or vice-versa. The dissolving properties of any of the parts may be affected by pressure, temperature, or a concentration of solvent.

In at least one embodiment, some or all of the parts of the bridge plug 100 may be made of a dissolvable material that includes a primary metal material alloyed with other elements and layered into place by advanced powder technology chemical processing. In some embodiments, the primary metal material may be magnesium, and the powder composition may be determined by the ratio of magnesium to other metal powders used to layer the rough material shapes of the parts. The material may then be consolidated with a combination of heat and pressure, and the resulting material can then be heat treated to the desired material strength.

Dissolvable parts of the bridge plug 100 may dissolve when in contact with fresh water or salt water. In at least one embodiment, a strong acid such as hydrochloric acid, sulfuric acid, or perchloric acid can accelerate the dissolution of the bridge plug 100. In some embodiments, for example, hydrochloric acid can be spotted (injected) just above (uphole) from the bridge plug 100 to speed the dissolution process.

The guide shoe 102 is arranged at the first or "downhole" end of the bridge plug 100 and may define or otherwise provide a beveled edge 114, which may help the bridge plug 100 run downhole and traverse liner tops and other obstructions without catching on sharp corners. In some embodiments, the guide shoe 102 may include a pump down ring 116, which may be arranged within a groove 118 defined on the guide shoe 102. As best seen in FIG. 1B, the guide shoe 102 may further include one or more slip pins 120 extending axially from the guide shoe 102 to help guide and orient the slip ring 104, as discussed in more detail below.

The slip ring 104, the sealing element 106, and the element backup ring 108 may each extend at least partially over the conical outer surface of the setting cone 110. At least the slip ring 104 and the sealing element 106 may have corresponding angled inner surfaces configured to slidingly engage the conical outer surface of the setting cone 110. The sealing element 106 may be made of any of the degradable rubber materials mentioned herein, but could alternatively be made of a non-degradable material, without departing from the scope of the disclosure. The element backup ring 108 may comprise a spiral wound member that interposes the slip ring 104 and the sealing element 106 and may operate to prevent the elastomeric material of the sealing element 106 from extruding, deforming, or otherwise creeping axially when the bridge plug 100 is set.

Figure 2A:
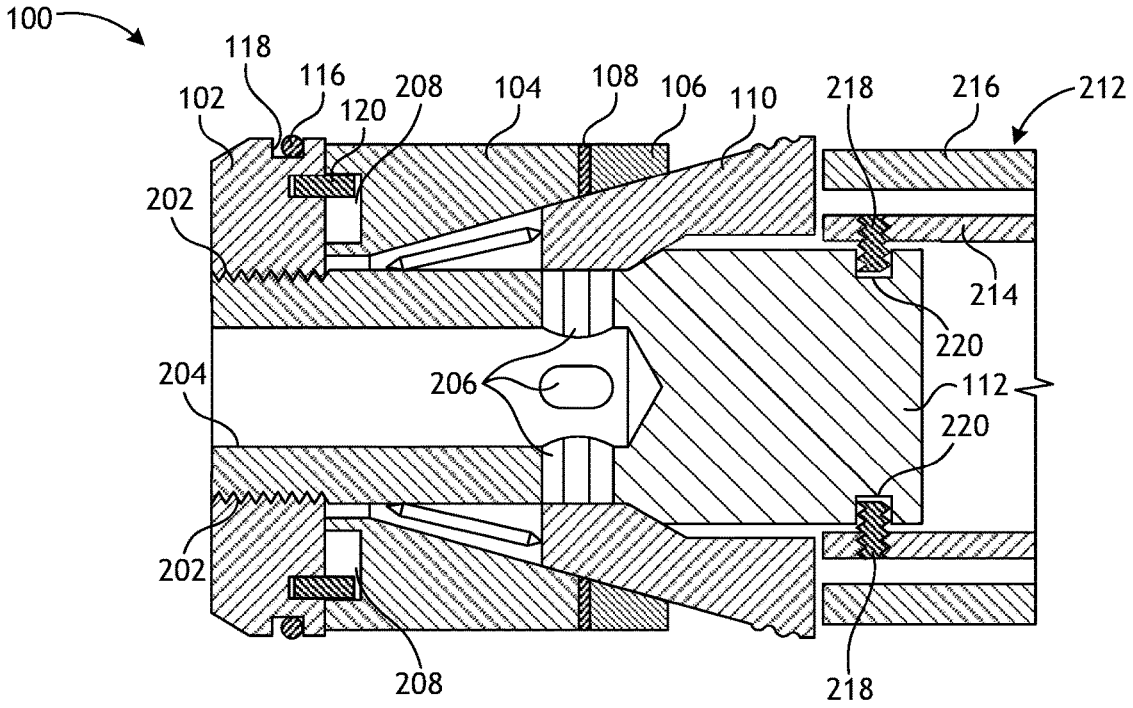
FIGS. 2A and 2B are cross-sectional side views of the bridge plug 100, according to one or more embodiments.
Figure 2B:
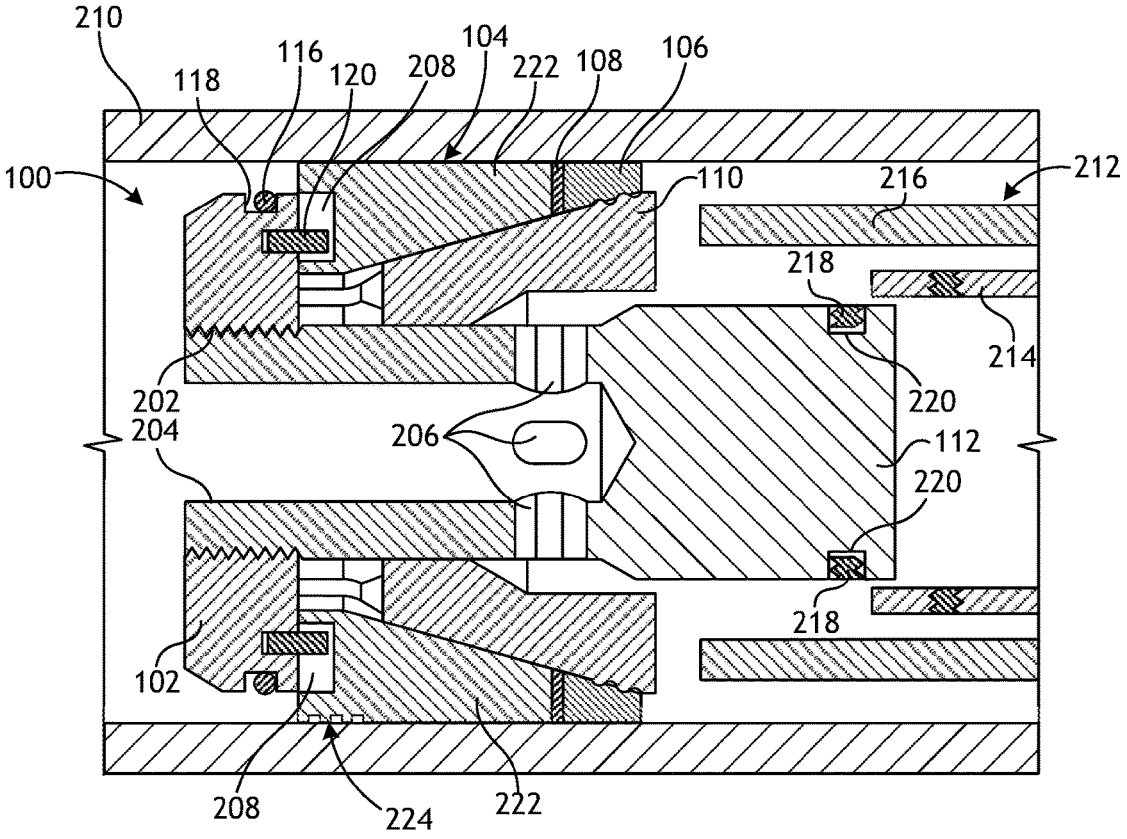

FIGS. 2A and 2B are cross-sectional side views of the bridge plug 100, according to one or more embodiments. More specifically, FIG. 2A depicts the bridge plug 100 in a run-in state, and FIG. 2B depicts the bridge plug 100 in a deployed state after the bridge plug 100 has been actuated and anchored within a wellbore.

As illustrated, the mandrel 112 may extend at least partially through the guide shoe 102, the slip ring 104, the sealing element 106, and the setting cone 110. The mandrel 112 may be threaded to the guide shoe 102 at a threaded interface 202, and may define or otherwise provide a through bore 204 that extends partially through the mandrel 112. In such embodiments, one or more ports 206 may also be defined in the mandrel 112 and may be in fluid communication with the through bore 204 to enable fluid flow through the mandrel 112. Moreover, in such embodiments, the mandrel 112 may be axially movable to help the bridge plug 100 isolate and hold pressure, as discussed below. In other embodiments, however, and as also discussed in more detail below, the through bore 204 may extend through the entire length of the mandrel 112. In such embodiments, the ports 206 may be omitted and the mandrel 112 may be used as a projectile seat.

The slip pins 120 extending axially from the guide shoe 102 may be received within corresponding and matching slots 208 defined in the slip ring 104. The slip pins 120 help maintain corresponding slip segments of the slip ring 104 radially aligned as they fracture and separate, which helps ensure that the resulting slip segments are evenly distributed around the circumference of the setting cone 110 to centralize the bridge plug 100 within the wellbore and support the element backup ring 108. In other embodiments, the slip pins 120 may be replaced with other types of structures, such as flat ramps or guides. In such embodiments, such structures may also help limit travel of the slip segments, and thereby help prevent the slip segments from sliding too far on one side or the other.

As depicted in FIG. 2B, the bridge plug 100 can be anchored within casing 210 installed in a wellbore. As used herein, the term "casing" refers to any wellbore tubular, tubing, pipe, or liner commonly used to line the inner wall of a wellbore. Accordingly, the casing 210 may alternatively be wellbore liner, as generally known in the art.

The bridge plug 100 may be run into the wellbore and the casing 210 as coupled to a setting tool 212. In at least one embodiment, the setting tool 212 may comprise a reusable or disposable pyrotechnic-type setting tool. As illustrated, the setting tool 212 may include a setting tool mandrel 214 and a setting tool sleeve 216. The bridge plug 100 may be connected to the setting tool 212 at the setting tool mandrel 214 with one or more shear screws 218 threaded into corresponding screw holes 220 defined in the mandrel 112. The shear screws 218 may be brass, stainless steel, or a dissolvable alloy similar to one or more parts of the bridge plug 100. The shear screws 218 may alternatively comprise other types of shearable devices, such as rolled pins, unthreaded rods, shear wire, shear rings, or any other shearable design commonly used in oilfield applications. In at least one embodiment, as illustrated, the setting tool sleeve 216 may be arranged to abut the uphole end of the setting cone 110.

The guide shoe 102 and the setting cone 110 may have the largest outside diameter of the bridge plug 100. The slip ring 104, the element backup ring 108, and the sealing element 106 may each exhibit a smaller diameter and, therefore, may be protected by the larger diameter guide shoe 102 and setting cone 110 during run-in. The pump down ring 116 installed in the groove 118 may provide a partial seal to the inside of the casing 210 for pumping the assembly to the bottom of a horizontal well. More specifically, the assembly of the bridge plug 100 and the setting tool 212 may be lowered into vertical portions of a wellbore on wireline or another type of conveyance. However, the bridge plug 100 and the setting tool 212 may need to be pumped through horizontal sections of the wellbore. The sealing effect of the pump down ring 116 against the inner wall of the casing 210 helps propel the bridge plug 100 and the setting tool 212 along horizontal sections as fluid exits through ports (not shown) defined in lower portions of the casing 210. The pump down ring 116 may be an O-ring, a t-seal, a molded seal, a wiper ring, or similar type sealing device.

In FIG. 2B, the bridge plug 100 has been set in the casing 210 and released from the setting tool 212. To accomplish this, the setting tool sleeve 216 applies an axial compression load (force) against the setting cone 110 while the setting tool mandrel 214 remains stationary and connected to the mandrel 112 at the shear screws 218. The conical outer surface of the setting cone 110 is thereby forced beneath the slip ring 104, which forces the slip ring 104 radially outward and into gripping engagement with the inner wall of the casing 210. The setting tool 212 releases from the bridge plug 100 when the setting tool mandrel 214 generates enough force to shear the shear screws 218 that hold the setting tool 212 to the mandrel 112. Once released from the bridge plug 100, the setting tool 212 may then be retrieved to surface.

In some embodiments, the slip ring 104 may be manufactured as a monolithic structure that defines or otherwise includes one or more weakened portions configured to break or fail when a predetermined setting force is applied, thus resulting in a plurality of individual slip segments 222. In other embodiments, however, the slip ring 104 could be made from the slip segments 222 and held together with a slip retainer ring (not shown). The slip retainer ring, for example, could be made from plastic, rubber, or metal and may bind the slip segments 222 together until enough force is applied to break the slip retainer ring and thereby free the slip segments 222 to move radially outward.

As the setting tool sleeve 216 applies compression force to the setting cone 110 to force the setting cone 110 beneath the slip ring 104, the slip ring 104 will eventually fracture into the individual slip segments 222 that travel up the conical outer surface of the setting cone 110 to engage and grip the inner wall of the casing 210. The slip pins 120 are slidingly engaged in the corresponding slots 208 of each slip segment 222, which helps keep the slip segments 222 radially aligned (e.g., angularly fixed) as they fracture (or separate) and are forced into contact with the casing 210. The radial alignment of the slip segments 222 keeps the slip segments 222 evenly distributed around the circumference of the setting cone 110 which centralizes the bridge plug 100 in the casing 210 and helps support the element backup ring 108.

In some embodiments, the outer surfaces of some or all of the slip segments 222 may be smooth. In other embodiments, however, some or all of the outer surface of the slip segments 222 may provide a tooth profile 224 (FIG. 2B). In yet other embodiments, some or all of the slip segments 222 may include a combination of smooth outer surfaces and outer surfaces that provide the tooth profile 224, without departing from the scope of the disclosure. In some embodiments, a gripping material, such as a grit or hardened proppant, may be applied to the smooth outside surfaces of the slip segments 222 or the tooth profile 224 with an epoxy or another suitable binder. The gripping material may be useful in helping to grip the inner wall of the casing 210 and thereby securely anchor the bridge plug 100 within the casing 210.

Figure 3A:
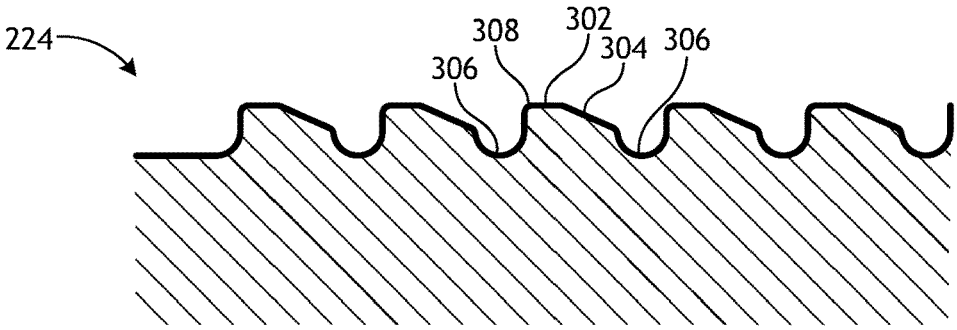
FIG. 3A is a cross-sectional side view of one example of the tooth profile of FIG. 2B, according to one or more embodiments.

FIG. 3A is a cross-sectional side view of one example of the tooth profile 224, according to one or more embodiments. In one or more embodiments, the tooth profile 224 may be similar to a thread profile in that each tooth is identical to the preceding and subsequent teeth in the axial direction. The tooth profile 224 may be machined with a circumferential path or a right hand or left hand helical path.

As illustrated, each tooth of the profile 224 may define or otherwise provide a tooth flat 302, an angled flank 304, a tooth root 306, and a front angle 308. The front angle 308 is formed between the tooth root 306 and tooth flat 302 and may exhibit a 90° angle. The tooth profile 224 may be configured to use a combination of the flats 302 and the front angle 308 to anchor to the inner wall of the casing 210 (FIG. 2B).

Figure 3B:
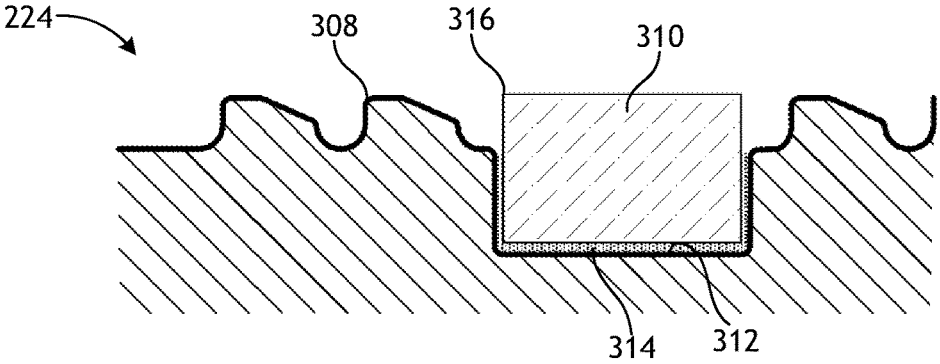
FIG. 3B is a cross-sectional side view of another example of the tooth profile of FIG. 2B, according to one or more additional embodiments.

FIG. 3B is a cross-sectional side view of another example of the tooth profile 224, according to one or more additional embodiments. The tooth profile 224 may be similar to the thread profile 224 depicted in FIG. 3A in that each tooth may be identical to the preceding and subsequent teeth in the axial direction. Moreover, the tooth profile 224 of FIG. 3B may be machined with a circumferential path or a right hand or left hand helical path.

Unlike the tooth profile 224 of FIG. 3A, however, the tooth profile 224 in FIG. 3B may include one or more slip buttons 310 (one shown) secured within a corresponding pocket 312 at the slip face and held within the pocket 312 with a dissolvable binder material 314. The pocket 312 in the slip face may be perpendicular or angled to the slip face so that it provides an edge 316 near or matching the front angle 308 of the tooth profile 224. In some embodiments, the slip buttons 310 may exhibit the shape of a round cylinder, but could alternatively comprise any prism with a geometric shape, such as square, triangular, ellipse, pyramid, hexagon, etc.

The slip buttons 310 may be made of any hard or ultrahard material including, but not limited to, ceramic, carbide, tungsten carbide, thermal polycrystalline diamond (TSP), hardened steel, or any combination thereof. In other embodiments, however, one or more of the slip buttons 310 may comprise a sintered ceramic material disk or ring held together with a dissolvable binder composed of magnesium or a magnesium-aluminum alloy. In such embodiments, the binder will dissolve when exposed to a solvent and release the ceramic materials into the wellbore. In an alternative embodiment, one or more of the slip buttons 310 may be comprise a ceramic proppant held together with a dissolvable magnesium and aluminum binder alloy. The binder dissolves in freshwater or salt water solution, thus releasing the ceramic proppant to fall to the bottom of the wellbore. In yet other embodiments, one or more of the slip buttons 310 may comprise tungsten carbide particles held together with a dissolvable magnesium and aluminum binder alloy. As the binder dissolves in freshwater or salt water solution, the tungsten carbide particles will be released and fall to the bottom of the wellbore.

Figure 4A:
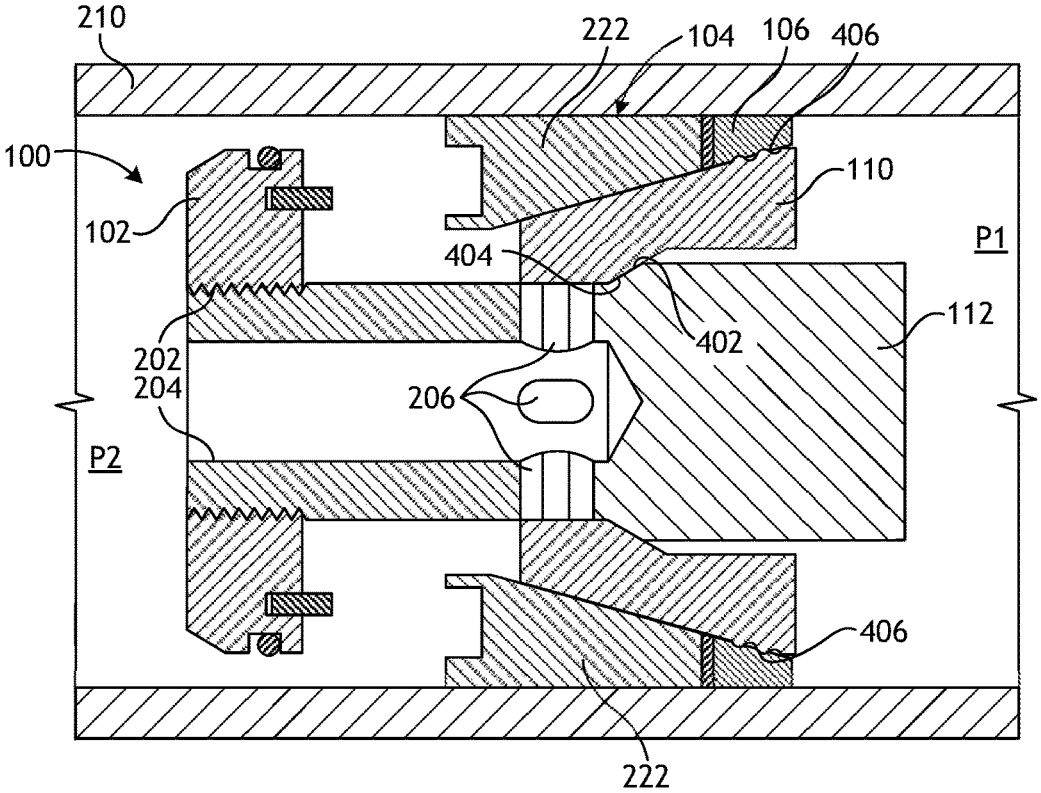
FIGS. 4A and 4B are cross-sectional side views of the bridge plug, according to one or more additional embodiments.

FIG. 4A is another cross-sectional side view of the bridge plug 100 of FIG. 1, following release from the setting tool 212 (FIG. 2B). After the bridge plug 100 has been set in the casing 210 and released from the setting tool 212, as generally described above, the guide shoe 102 and the plug mandrel 112 may be free to move. As discussed above, the guide shoe 102 can be threadably engaged to the mandrel 112 at the threaded interface 202 and therefore reacts as a unitary body or subassembly.

The connected guide shoe 102 and plug mandrel 112 can move downwards (i.e., downhole) until an angled outer surface 402 provided on the mandrel 112 comes into contact with an opposing angled inner surface 404 provided on the setting cone 110. In a vertical well, gravity will force the combined guide shoe 102 and mandrel 112 downwards until the angled outer surface 402 contacts the angled inner surface 404. In a horizontal well, however, fluid may be pumped downhole and circulated through the ports 206 and the interconnected through bore 204 to create a pressure drop across the bridge plug 100, and the resulting fluid friction may force the combined guide shoe 102 and mandrel 112 downhole until the surfaces 402, 404 come into contact. The pressure differential may be generated as the uphole pressure P1 (i.e., above the bridge plug 100) becomes greater than the downhole pressure P2 (i.e., below the bridge plug 100). In some embodiments, a metal-to-metal fluid seal may be formed when the two surfaces 402, 404 come into contact, and the pressure differential may help energize the sealed interface to hold pressure and isolate the wellbore from above.

The pressure differential P1−P2 may affect the entire cross-sectional area of the bridge plug 100 when the mandrel 112 seals against the setting cone 110. More particularly, the force generated by the pressure on the cross-sectional area may create a force perpendicular to the conical outer surface of the setting cone 110, which may push the slip segments 222 of the slip ring 104 into greater gripping engagement with the inner wall of the casing 210. The increased gripping engagement and transfer of force into the casing 210 may cause outward radial casing flexure, often seen as a bulge in the outside of the casing 210. When the slip segments 222 cause the casing 210 to bulge, the setting cone 110 will travel axially underneath the slip ring 104 even further.

In some embodiments, a series of protrusions or ridges 406 may be defined on the outer conical surface of the setting cone 110. As the setting cone 110 moves further beneath the slip ring 104, the ridges 406 may be forced under the sealing element 106, which may enhance the sealing capacity of the sealing element 106 by increasing the rubber pressure against the inner wall of the casing 210.

Figure 4B:
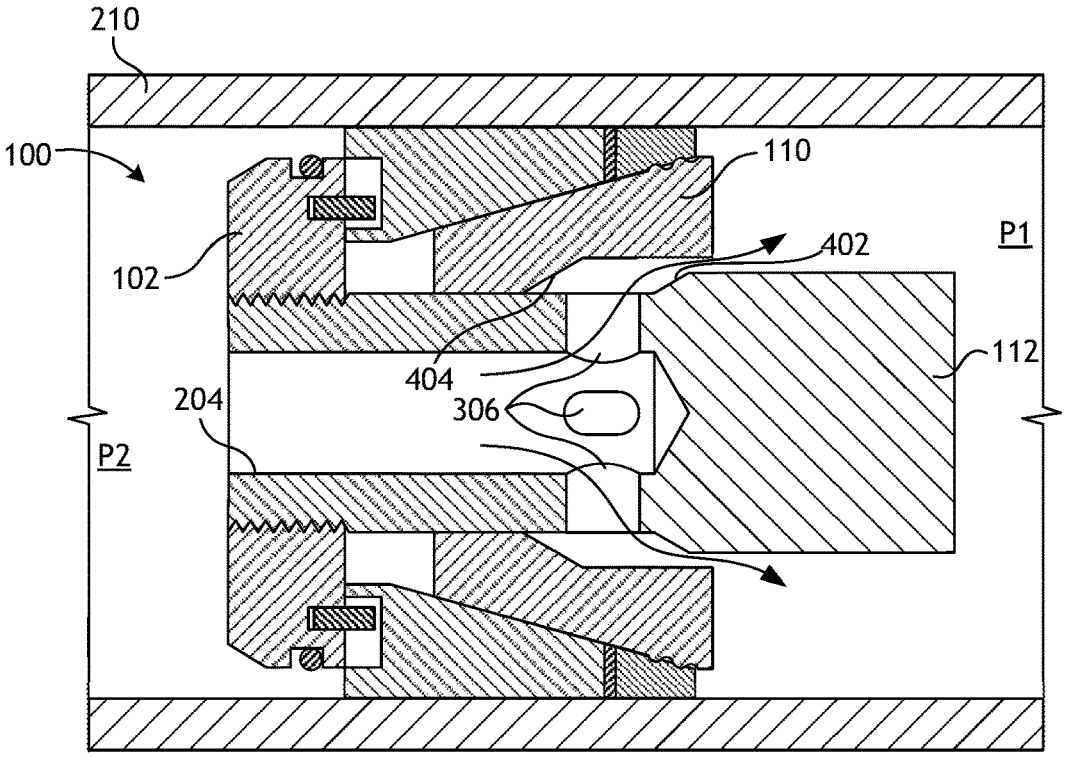

In FIG. 4B, a pressure differential from downhole, where P2>P1, may unseal the bridge plug 100 and otherwise move the combined guide shoe 102 and mandrel 112 upwards (uphole), which disengages the angled outer surface 402 from the angled inner surface 404 and thereby allows fluid flow through the bridge plug 100 by traversing the through bore 204 and the ports 206. This feature may be useful during cleanout of a zone after a hydraulic fracturing operation. In such embodiments, additional fluid flow may come from a recently completed zone located downhole from the bridge plug 100, and the additional flow will aid in cleanout.

Figure 5A:
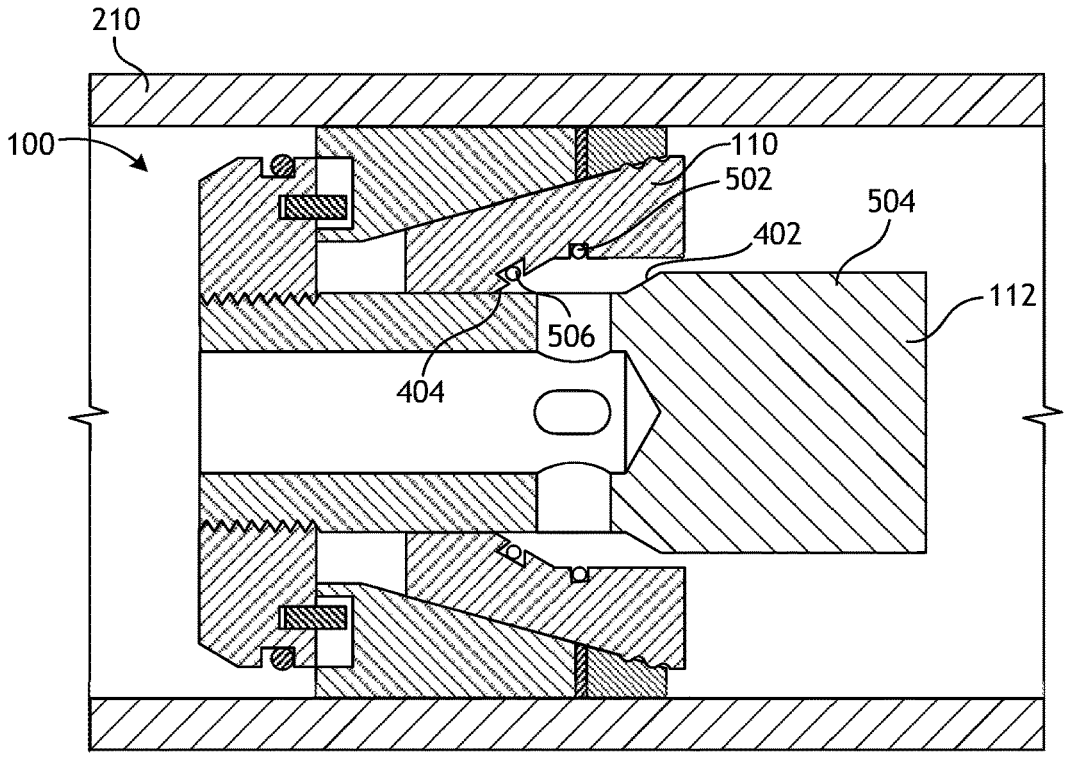
FIGS. 5A and 5B are cross-sectional side views of the bridge plug, according to one or more additional embodiments.

FIG. 5A is another cross-sectional side view of the bridge plug 100, according to one or more additional embodiments. In the illustrated embodiment, the metal-to-metal seal between the mandrel 112 and the setting cone 110 at the opposing angled surfaces 402, 404 is replaced by one or more seals. More specifically, in some embodiments, one or more radial seals 502 may be positioned on the setting cone 110 and may be configured to sealingly engage an outer surface 504 of the mandrel 112. In other embodiments, or in addition thereto, one or more cone seals 506 may be positioned on the inner angled surface 404 of the setting cone 110 and configured to sealingly engage against the outer angled surface 402 of the mandrel 112. The radial and cone seals 502, 506 may comprise, for example, an O-ring, a t-seal, a molded seal, or a similar known seal.

As will be appreciated, the position of the radial and cone seals 502, 502 may be reversed, where the radial seal 502 is alternatively positioned on the outer surface 504 of the mandrel 112 to sealingly engage the setting cone 110, and the cone seal 506 is alternatively positioned on the outer angled surface 404 of the mandrel 112 to sealingly engage the inner angled surface 404 of the setting cone 110, without departing from the scope of the disclosure.

Figure 5B:
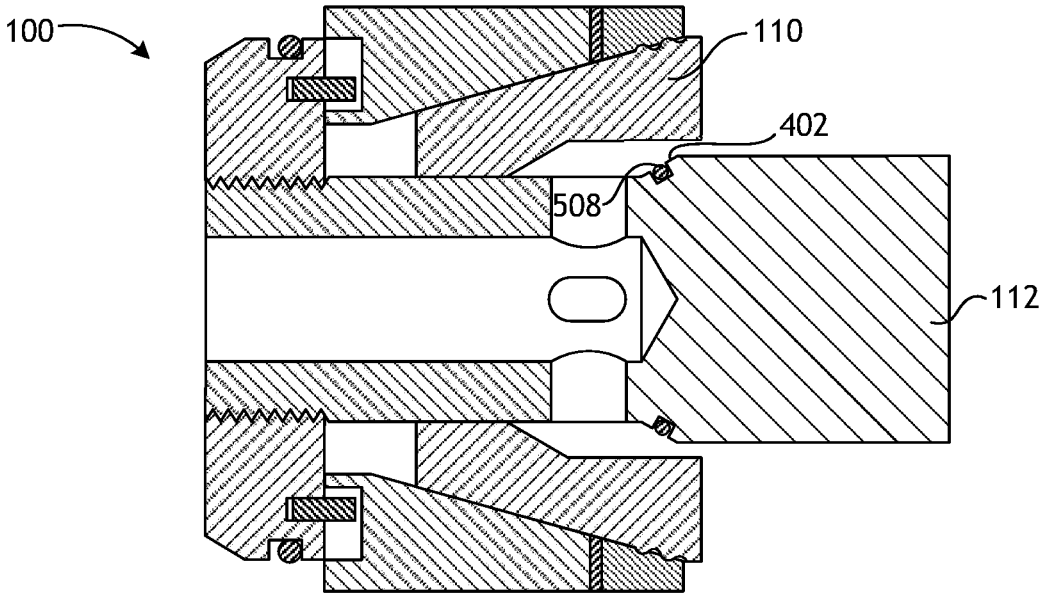

FIG. 5B is another cross-sectional side view of the bridge plug 100, according to one or more additional embodiments. In the illustrated embodiment, the metal-to-metal seal between the mandrel 112 and the setting cone 110 is replaced by (or enhanced with) one or more face seals 508 positioned on the outer angled surface 402 of the mandrel 112 and configured to sealingly engage the inner angled surface 404 of the setting cone 110. The face seals 508 may comprise, for example, an O-ring, a t-seal, a molded seal, or a similar known seal.

Figure 6:
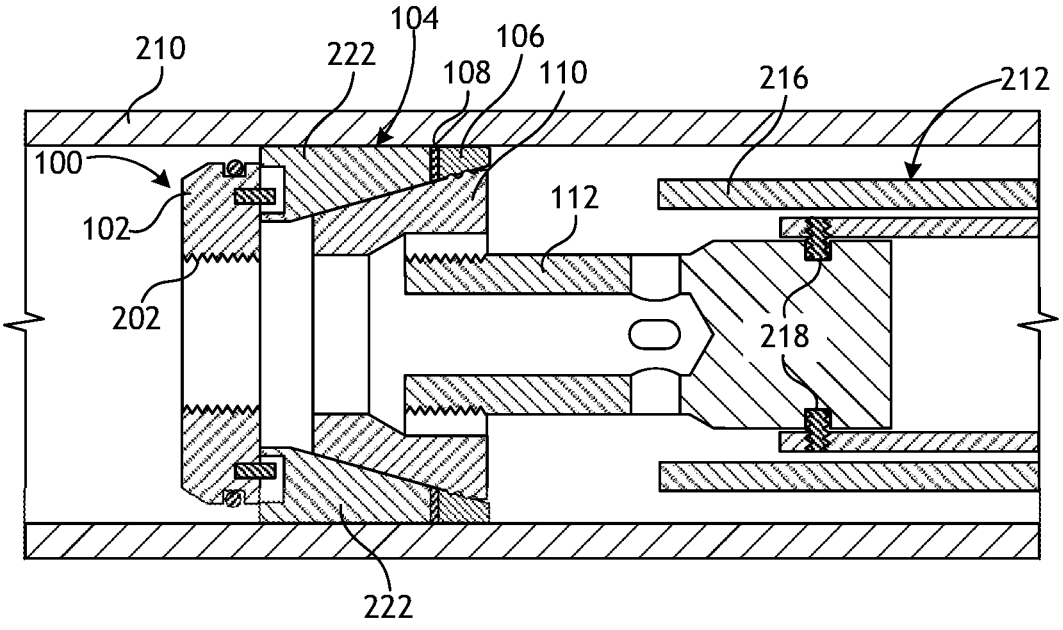
FIG. 6 is a cross-sectional side view of another embodiment of the bridge plug.

FIG. 6 is a cross-sectional side view of another embodiment of the bridge plug 100. In the illustrated embodiment, the threaded interface 202 between the guide shoe 102 and the mandrel 112 may be shearable or otherwise frangible. In such embodiments, the bridge plug 100 may be deployed within the casing 210, as generally described above, after which the setting tool 212 may continue to place an axial load on the setting cone 110 via the setting sleeve 216. The shear screws 218 may have a shear rating that is greater than the shear rating of the threaded interface 202 and, consequently, the threaded interface 202 will fail before the shear screws 218 fail, thus allowing the setting tool 212 to separate the mandrel 112 from the guide shoe 102. Alternatively, the mandrel 112 could be welded to or otherwise made an integral part of the setting tool 212. In such embodiments, the shear screws 218 may be omitted as unnecessary.

Once the setting tool 212 separates the mandrel 112 from the guide shoe 102, the setting tool 212 and the mandrel 112 may be jointly conveyed back uphole. Once separated from the mandrel 112, the guide shoe 102 may fall away from the remaining set portions of the bridge plug 100.

In some embodiments, the threads on the mandrel 112 may be shearable, but the threads on the guide shoe 102 may alternatively be shearable, or both threads may be shearable. In other embodiments, the threaded interface 202 may comprise or otherwise be replaced with one or more shear screws, one or more shear rings, or any other type of shearable member or connection that couples the guide shoe 102 to the mandrel 112 and designed to fail upon assuming a predetermined axial load. In at least one embodiment, the mandrel 112 may form an integral part of the setting tool 212 instead of forming part of the bridge plug 100. In such embodiments, the mandrel 112 may simply be used to couple the setting tool 212 to the bridge plug.

Figure 7:
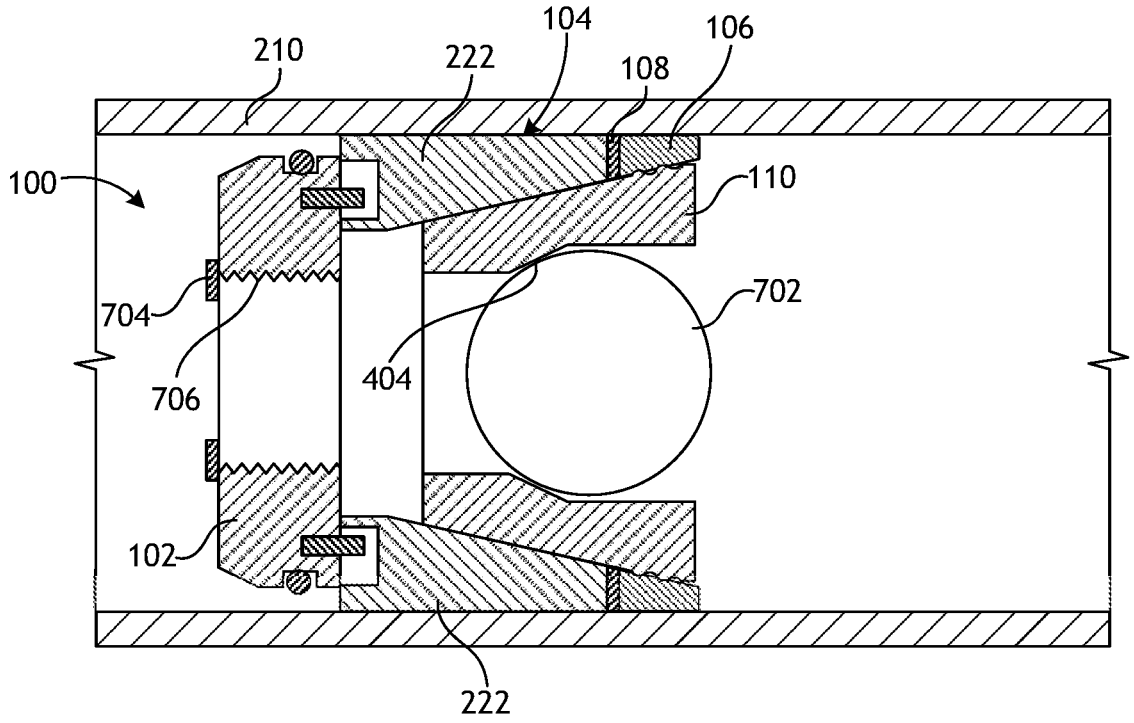
FIG. 7 is a cross-sectional side view of the bridge plug without the mandrel and the setting tool.

In FIG. 7, the mandrel 112 and the setting tool 212 have been removed from the bridge plug 100, which remains anchored to the inner wall of the casing 210. Without the mandrel 112, the inner radial surfaces of the setting cone 110, such as the inner angled surface 404 (or any other inner surface), may be used as a type of projectile (ball) seat. In such embodiments, a wellbore projectile 702 may be dropped from the surface of the well and flowed to the bridge plug 100 where it engages and seats against the inner angled surface 404 of the setting cone 110. Once engaging the inner angled surface 404, the wellbore projectile 702 may operate to isolate fluid pressure from above, while simultaneously allowing fluid flow from below the bridge plug 100 when uphole flow is desired. The wellbore projectile 702 may comprise any fluid isolating member known to the oilfield industry including, but not limited to, a ball, a dart, a wiper plug, or any combination thereof.

In some embodiments, the guide shoe 102 may have an interference member 704 that extends at least partially into a flow path 706 defined through the guide shoe 102 and the bridge plug 100. The interference member 704 may be configured to prevent a second wellbore projectile (not shown) that may be located downhole from the bridge plug 100 from flowing back uphole and past the bridge plug 100. The second wellbore projectile may be associated with a second dissolvable plug assembly located in a lower zone within the wellbore. The interference member 704 may comprise a protrusion extending past the threaded interface 202, but could alternatively comprise a slotted structure that might allow fluid flow around the second wellbore projectile upon engaging the interference member 704.

With reference to both FIGS. 6 and 7, in some embodiments, the slip ring 104, the element backup ring 108, the sealing element 106, and the setting cone 110 may each be made of non-dissolving, but easily millable materials such as, but not limited to, a composite epoxy and glass fiber, fiberglass, a thermoplastic, a fiber filled plastic, an aluminum alloy, or similar materials that are easy to mill. The remainder of the bridge plug 100 may be made from one or more dissolvable materials. In such embodiments, the bridge plug 100 may be set in the casing 210 as a plug and the mandrel 112 may be a sliding mandrel valve or may alternatively comprise a solid isolation plug. A well zone fracturing operation may be performed, and the dissolvable parts will dissolve until only the millable projectile seat parts of the bridge plug 100 remain; e.g., the slip segments 222, the element backup ring 108, the sealing element 106, and the setting cone 110. The zone may then be isolated by dropping a wellbore projectile (e.g., the wellbore projectile 702) from surface to seal against the setting cone 110 at the inner angled surface 404, for example. The bridge plug 100 may subsequently be removed by milling using a junk mill or drill bit.

Figure 8:
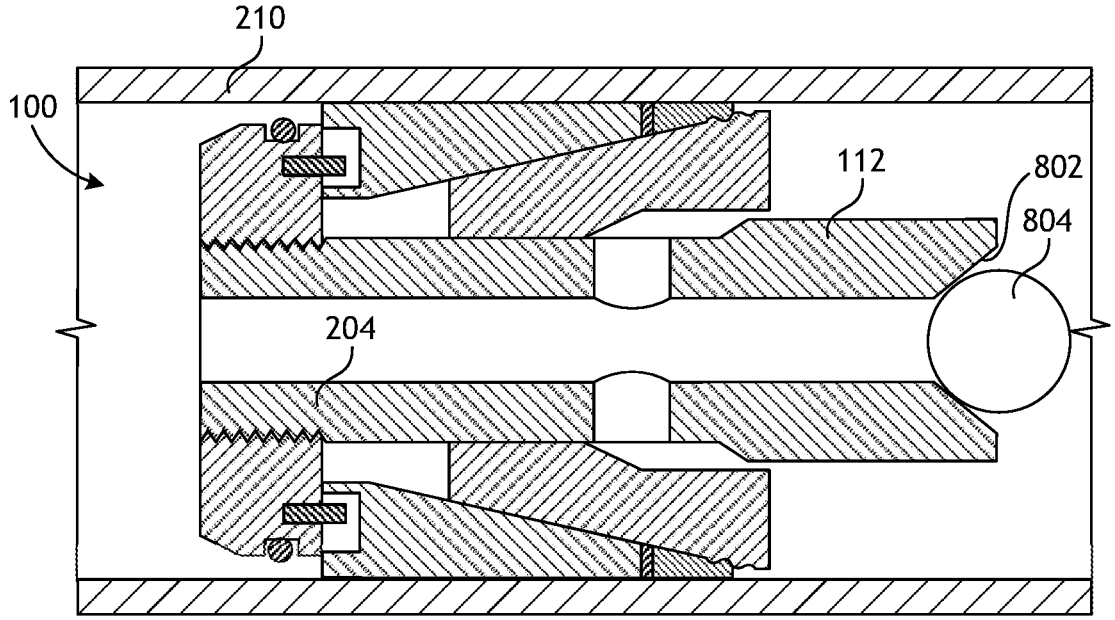
FIG. 8 is a cross-sectional side view of another embodiment of the bridge plug.

FIG. 8 is a cross-sectional side view of another embodiment of the bridge plug 100. As illustrated, the through bore 204 defined by the mandrel 112 extends along the entire axial length of the mandrel 112. Moreover, the mandrel 112 may further define or otherwise provide a projectile seat 802 on its uphole end. The bridge plug 100 is set first in the casing 210 following which a wellbore projectile 804 may be dropped downhole from the well surface. This embodiment allows flow from below (downhole) the bridge plug 100 and from above (uphole) until the wellbore projectile 804 is dropped from surface and successfully locates the projectile seat 802.

Figure 9:
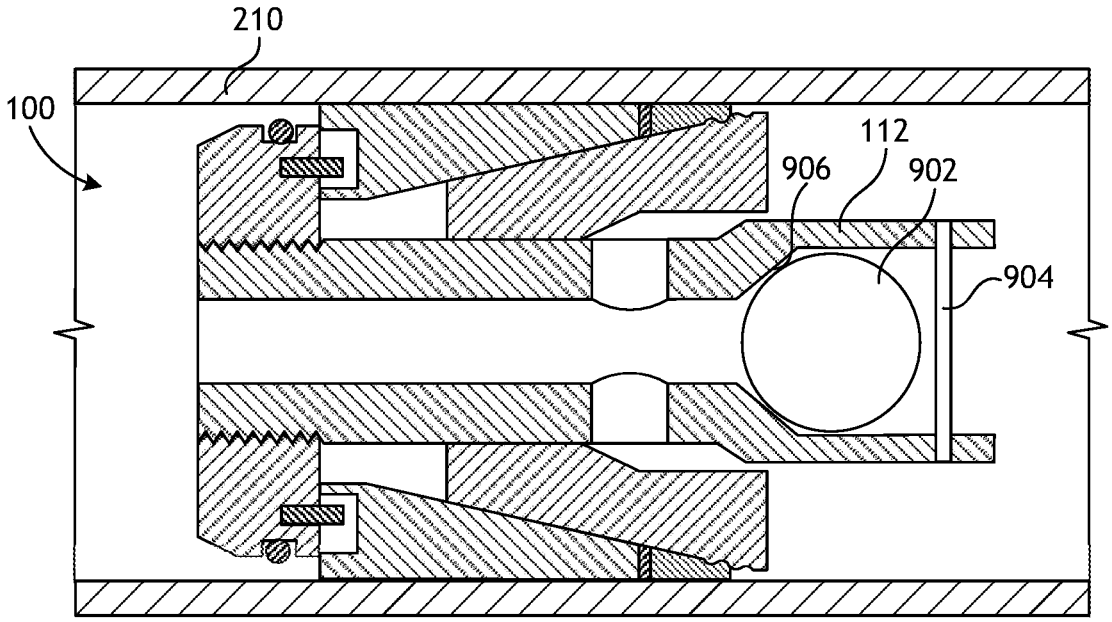
FIG. 9 is a cross-sectional side view of another embodiment of the bridge plug.

FIG. 9 is a cross-sectional side view of another embodiment of the bridge plug 100. As illustrated, the bridge plug 100 may include a wellbore projectile 902 captured within a cage 904 provided on the uphole end of the mandrel 112. In operation, the captured wellbore projectile 904 may be configured as a check valve after the bridge plug 100 is set in the casing 210. The set bridge plug 100 allows flow from below the bridge plug 100, but prevents flow from above as the wellbore projectile 904 seals against a projectile seat 906 defined by the mandrel 112.

Figure 10A:
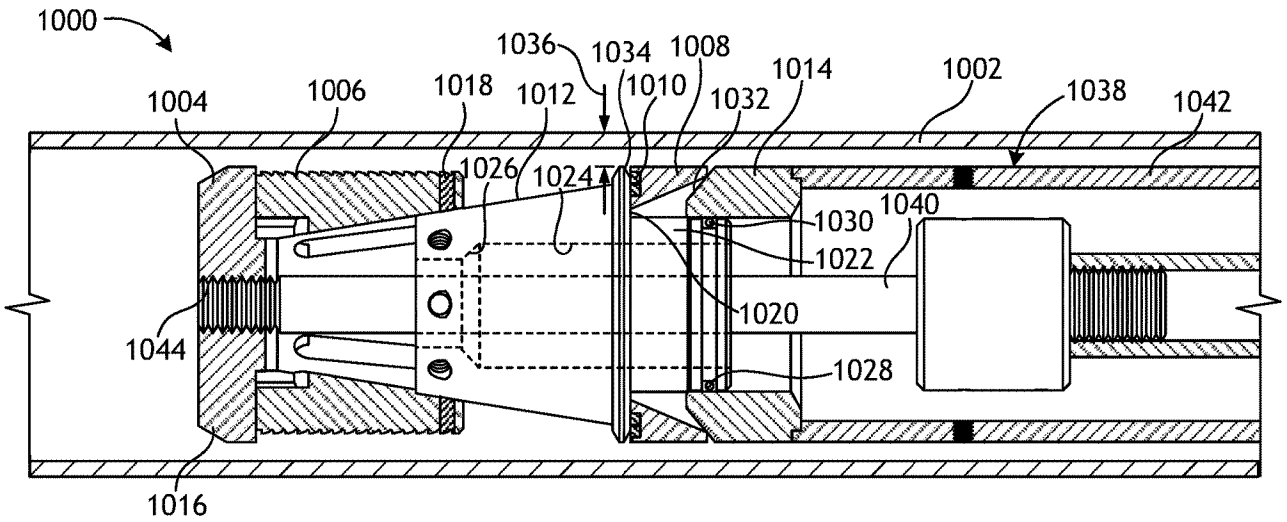
FIGS. 10A and 10B are partial cross-sectional side views of another example bridge plug that may incorporate the principles of the present disclosure.
Figure 10B:
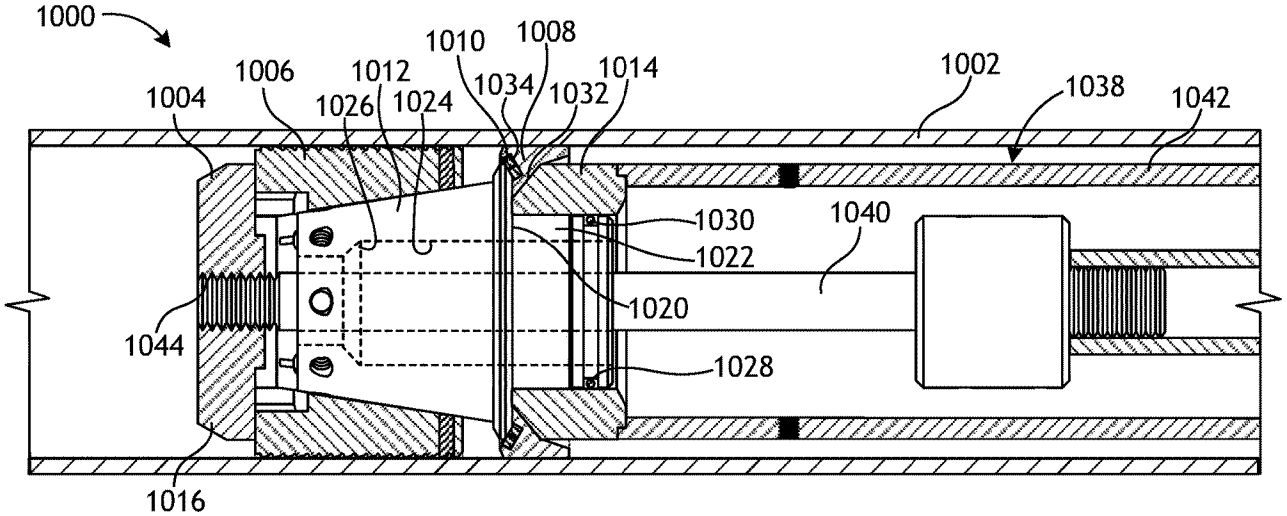

FIGS. 10A and 10B are partial cross-sectional side views of another example bridge plug 1000 that may incorporate the principles of the present disclosure. FIG. 10A depicts the bridge plug 1000 in a run-in state, and FIG. 10B depicts the bridge plug 1000 in a deployed state after the bridge plug 1000 has been actuated and anchored within casing or liner, collectively referred to as "casing 1002," that lines the inner wall of a wellbore.

The bridge plug 1000, alternately referred to as a "frac plug," may be similar in some respects to the bridge plug 100 of FIGS. 1A-1B and therefore may be best understood with reference thereto. Similar to the bridge plug 100, for example, the bridge plug 1000 has one or more dissolvable component parts and is configured to anchor itself to the casing 1002 upon actuation. Moreover, the bridge plug 1000 may incorporate or otherwise include a closable flow path designed to allow flow from below (i.e., downhole), but prevent flow from above (i.e., uphole), and may thus operate as a temporary one-way check valve.

As illustrated, the bridge plug 1000 includes a guide shoe 1004, a slip ring 1006, a sealing element 1008, an element backup ring 1010, a setting cone 1012, and a push ring 1014. Some or all of the foregoing parts may be made of any of the dissolvable materials mentioned herein and otherwise degradable upon coming into contact with specific solvents. The individual parts of the bridge plug 1000 may dissolve at the same rate or at different rates by design. Some of the parts may be manufactured with two or more dissolvable alloys, which allows the alloy located along the outside (e.g., further from the centerline of the bridge plug 1000) to dissolve slowly and the alloy located inside (e.g., closer to the centerline of the bridge plug 1000) to dissolve more quickly, or vice-versa. The dissolving properties of any of the parts may be affected by pressure, temperature, or a concentration of solvent.

In at least one embodiment, some or all of the parts of the bridge plug 1000 may be made of a dissolvable material that includes a primary metal material alloyed with other elements and layered into place by advanced powder technology chemical processing. In some embodiments, the primary metal material may be magnesium, and the powder composition may be determined by the ratio of magnesium to other metal powders used to layer the rough material shapes of the parts. The material may then be consolidated with a combination of heat and pressure, and the resulting material can then be heat treated to the desired material strength.

Dissolvable parts of the bridge plug 1000 may dissolve when in contact with fresh water or salt water. In at least one embodiment, a strong acid such as hydrochloric acid, sulfuric acid, or perchloric acid can accelerate the dissolution of the bridge plug 1000. In some embodiments, for example, hydrochloric acid can be spotted (injected) just above (uphole) from the bridge plug 1000 to speed the dissolution process.

The guide shoe 1004 is arranged at the first or "downhole" end of the bridge plug 1000 and may define or otherwise provide a beveled edge 1016 to help the bridge plug 1000 traverse liner tops and other obstructions within the casing 1002 without catching on sharp corners while running downhole.

The slip ring 1006 may extend at least partially over the conical outer surface of the setting cone 1012 may have a corresponding angled inner surface configured to slidingly engage the conical outer surface of the setting cone 1012. The slip ring 1006 may be the same as or similar to the slip ring 104 of FIGS. 1A and 1B. Consequently, in some embodiments, the slip ring 1006 may be manufactured as a monolithic structure that defines or otherwise includes one or more weakened portions configured to break or fail when a predetermined setting force is applied, thus resulting in a plurality of individual slip segments. In other embodiments, however, the slip ring 1006 may comprise the individual slip segments held together with a slip retainer ring 1018, similar to the slip retainer ring discussed above.

The setting cone 1012 provides a generally frustoconical structure terminating at an uphole shoulder 1020 and having an uphole extension 1022 extending uphole from the uphole shoulder 1020. The setting cone 1012 may define or otherwise provide a through bore 1024 that extends through the setting cone 1012 between its downhole and uphole ends. As discussed herein, the through bore 1024 may operate as an inner flow path through the bridge plug 1000 when the bridge plug 1000 is anchored within the casing 1002. Moreover, a projectile seat 1026 may be provided within or otherwise defined by the through bore 1024 and configured to receive a wellbore projectile (not shown). Once properly landed on the projectile seat 1026 the wellbore projectile may be capable of isolating downhole portions of the wellbore for various downhole applications.

The uphole extension 1022 may be received within or otherwise extend into the push ring 1014, and may sealingly engage the inner diameter of the push ring 1014. More specifically, the uphole extension 1022 may define one or more grooves 1028 (one shown) that receive a corresponding one or more seals 1030 (one shown) configured to seal the interface between the setting cone 1020 (i.e., the uphole extension 1022) and the push ring 1014. The seal 1030 may comprise, for example, an O-ring, a t-seal, a molded seal, a wiper ring, a metal-metal seal (e.g., a press-fit or interference fit seal), or a similar type sealing device. The seal 1030 may prove advantageous in providing an additional seal/barrier for pressure isolation.

The sealing element 1008 may be made of any of the degradable rubber materials mentioned herein, but could alternatively be made of a non-degradable material, without departing from the scope of the disclosure. The element backup ring 1010 may be made of a degradable metal or other degradable rigid material. In operation, the element backup ring 1010 may operate to prevent the elastomeric material of the sealing element 1008 from extruding, deforming, or otherwise creeping axially when the bridge plug 1000 is set (deployed) and, as indicated above, it may be made of an easily millable material.

The sealing element 1008 axially interposes the setting cone 1012 and the push ring 1014. More specifically, the sealing element 1008 may extend radially about the uphole extension 1022 and extend axially from the uphole shoulder 1020 toward the push ring 1014. As illustrated, the push ring 1014 may provide or otherwise define a downhole ramped surface 1032 engageable with the sealing element 1008. During the bridge plug 1000 setting process, as provided below, the push ring 1014 will be forced into axial engagement with the sealing element 1008, which correspondingly forces the sealing element 1008 against the uphole shoulder 1020 of the setting cone 1020. The downhole ramped surface 1032 helps urge the sealing element 1008 radially outward and toward the inner surface of the casing 1002 to sealingly engage the inner wall of the casing 1002. Moreover, the uphole shoulder 1020 may further provide or otherwise define a beveled edge 1034 that receives a portion of the sealing element 1008 as it is forced radially outward by the push ring 1014. The beveled edge 1034 may effectively operate as a funnel that redirects the portion of the sealing element 1008 into a radial gap 1036 (FIG. 10A) defined between the uphole shoulder 1020 and the inner wall of the casing 1002. Consequently, the beveled edge 1034 helps provide a more robust seal as the sealing element 1008 is guided and urged toward the inner wall of the casing 1002.

The bridge plug 1000 may be run into the wellbore as coupled to a setting tool 1038, which may be similar in some respects to the setting tool 212 of FIG. 2B. As illustrated, the setting tool 1038 may include an inner adapter 1040 and a setting tool sleeve 1042. In one or more embodiments, the setting tool sleeve 1042 may be arranged to abut the uphole end of the push ring 1014, and the inner adapter 1040 may connect the setting tool 1038 to the bridge plug 1000. More specifically, the inner adapter 1040 may be coupled to the guide shoe 1004 at a shearable interface 1044 configured to shear or fail upon assuming a predetermined axial load.

Accordingly, the setting tool 1038 may release from the bridge plug 1000 when the inner adapter 1040 generates enough axial loading to shear the shearable interface 1044.

In some embodiments, as illustrated, the shearable interface 1044 may comprise a threaded interface. In such embodiments, the downhole end of the inner adapter 1040 may be threadably attached to the guide shoe 1004 and configured to separate (shear) upon assuming a predetermined axial load at the shearable interface 1044. In other embodiments, however, the shearable interface 1044 may comprise one or more shear screws, one or more shear rings, or any other type of shearable member or connection that couples the guide shoe 1004 to the inner adapter 1040 and is designed to fail upon assuming the predetermined axial load.

In FIG. 10B, the bridge plug 1000 has been set (deployed) in the casing 1002. To accomplish this, the inner adapter 1040 may be pulled uphole (i.e., to the right in FIG. 10B) while the setting tool sleeve 1042 is maintained stationary or otherwise pushed downhole. Pulling uphole on the inner adapter 1040 places an axial compression load on the connected guide shoe 1004, which pushes against the slip ring 1006. Moreover, as the inner adapter 1040 pulls uphole, the setting tool sleeve 1042 is correspondingly forced against the push ring 1014, which applies an axial compression load (force) that advances the push ring 1014 toward the uphole shoulder 1020. Upon engaging the uphole shoulder 1020, the conical outer surface of the setting cone 1012 will be forced beneath the slip ring 1006, which will radially expand and eventually fracture into the individual slip segments to engage and grip the inner wall of the casing 1002.

In some embodiments, the outer surfaces of some or all of the slip segments may be smooth. In other embodiments, however, some or all of the outer surface of the slip segments may provide a tooth profile (e.g. the tooth profile 224 of FIG. 2B). In yet other embodiments, some or all of the slip segments may include a combination of smooth outer surfaces and outer surfaces that provide the tooth profile, without departing from the scope of the disclosure. Moreover, in one or more embodiments, the one or more slip buttons 310 (FIG. 3) may be secured to the slip face to help enhance the gripping capacity. In some embodiments, a gripping material, such as a grit or hardened proppant, may be applied to the smooth outside surfaces of the slip segments or the tooth profile with an epoxy or another suitable binder. The gripping material, an addition to the tooth profile and/or the slip buttons 310, may be useful in helping to grip the inner wall of the casing 1002 and thereby securely anchor the bridge plug 1000 within the casing 1002.

Moving the push ring 1014 toward the uphole shoulder 1020 also allows the push ring 1014 to engage the sealing element 1008. As mentioned above, the downhole ramped surface 1032 of the push ring 1014 forces the sealing element 1008 radially outward toward the inner surface of the casing 1002 to sealingly engage the inner wall of the casing 1002. Moreover, the beveled edge 1034 defined on the uphole shoulder 1020 may receive a portion of the sealing element 1008 forced radially outward and redirect the sealing element 1008 into the radial gap 1036 (FIG. 10A) defined between the uphole shoulder 1020 and the casing 1002. In some embodiments, the element backup ring 1010 may rest on the beveled edge 1034 to prevent all of the elastomeric material of the sealing element 1008 from extruding, deforming, or otherwise creeping axially through the gap 1036. Accordingly, in one or more embodiments, the sealing element 1008 may transition location from a generally flat surface (i.e., the uphole shoulder 1020) to an angled surface (i.e., the beveled edge 1034) during actuation, and thereby create rapid expansion to maximize sealing of the outer diameter of the bridge plug 1000.

Once the bridge plug 1000 is properly anchored within the casing 1002, the setting tool 1038 may be released. To accomplish this, the inner adapter 1040 may be pulled uphole as connected to the guide shoe 1004 until achieving a predetermined axial load, at which point the shearable interface 1044 will fail and release the setting tool 1038 to be retrieved to surface. Upon shearing the shearable interface 1044, the guide shoe 1004 may fall away from the set portions of the bridge plug 1000, which remains anchored to the inner wall of the casing 1002.

In some embodiments, as illustrated, when the bridge plug 1000 is set, the projectile seat 1026 provided within the through bore 1024 may be radially aligned with the segments of the slip ring 1006 and otherwise located downhole from the sealing element 1008. Having the projectile seat 1026 located in radial alignment with the segments of the slip ring 1006 may help prevent the setting cone 1012 from experiencing collapse force and may also help support the slip segments during setting. The projectile seat 1026 may then be used to receive and seat a wellbore projectile (not shown), such as the wellbore projectile 702 of FIG. 7. In such operations, the wellbore projectile may be dropped from the surface of the well and flowed to the bridge plug 1000 where it engages and seats against the projectile seat 1026 to form a sealed interface. The wellbore projectile may then operate to isolate fluid pressure from above, while simultaneously allowing fluid flow from below the bridge plug 1000 when uphole flow is desired.

Embodiments Disclosed Herein Include:

A. A bridge plug that includes a mandrel, a setting cone disposed at least partially about the mandrel, a slip ring and a sealing element disposed at least partially about the setting cone, and a guide shoe operatively coupled to a downhole end of the mandrel, wherein the bridge plug is actuatable from a run-in state to a deployed state, and wherein, when the bridge plug is in the deployed state, the mandrel is axially movable relative to the setting cone to seal or open a flow path through the bridge plug.

B. A bridge plug that includes a slip ring, a setting cone extendable within the slip ring and having a frustoconical structure terminating at an uphole shoulder and an uphole extension extending from the uphole shoulder, a push ring arranged about the uphole extension, and a sealing element extending radially about the uphole extension and axially interposing the uphole shoulder and the push ring, wherein the bridge plug is actuatable from a run-in state to a deployed state, and wherein, when the bridge plug is in the deployed state, the push ring forces the setting cone into the slip ring to radially expand the slip ring and the push ring further forces the sealing element radially outward and into sealing engagement with an inner surface of casing.

C. A method that includes running a bridge plug into a wellbore as attached to a setting tool, the bridge plug including a slip ring, a setting cone extendable within the slip ring and having a frustoconical structure terminating at an uphole shoulder and an uphole extension extending from the uphole shoulder, a push ring arranged about the uphole extension, and a sealing element extending radially about the uphole extension and axially interposing the uphole shoulder and the push ring. The method further includes actuating the setting tool from a run-in state to a deployed state and thereby urging the push ring into engagement with the setting cone, radially expanding the slip ring as the setting cone advances into the slip ring and anchoring the slip ring against an inner wall of casing that lines the wellbore, forcing the sealing element radially outward and into sealing engagement with an inner surface of the casing with the push ring.

Each of embodiments A, B, and C may have one or more of the following additional elements in any combination: Element 1: wherein at least one of the mandrel, the setting cone, the slip ring, the sealing element, and the guide shoe is made of a dissolvable material selected from the group consisting of a dissolvable metal, a galvanically-corrodible metals, a degradable polymer, a degradable rubber, borate glass, polyglycolic acid, polylactic acid, a dehydrated salt, and any combination thereof. Element 2: further comprising one or more slip pins extending axially from the guide shoe and received within a corresponding one or more slots defined in the slip ring. Element 3: wherein the mandrel defines a through bore extending only partially through the mandrel, and wherein one or more ports are defined in the mandrel and fluidly communicate with the through bore to allow fluid flow through the mandrel. Element 4: wherein an angled outer surface defined by the mandrel is sealingly engageable with an opposing angled inner surface defined by the setting cone, and wherein sealingly engaging the angled outer surface against the opposing angled inner surface prevents fluid flow through the bridge plug. Element 5: wherein the mandrel defines a through bore extending an entire length of the mandrel and further defines a projectile seat sized to receive a wellbore projectile. Element 6: further comprising a tooth profile defined on an outer surface of the slip ring, wherein the tooth profile includes one or more slip buttons secured within a corresponding pocket and each slip button is secured within the corresponding pocket with a dissolvable binder material. Element 7: wherein the one or more slip buttons exhibit a cross-sectional shape selected from the group consisting of a circular, oval, ovoid, polygonal, or any combination thereof. Element 8: wherein at least one of the one or more slip buttons is made with a dissolvable binder material.

Element 9: wherein at least one of the slip ring, the setting cone, the push ring, and the sealing element is made of a dissolvable material selected from the group consisting of a dissolvable metal, a galvanically-corrodible metals, a degradable polymer, a degradable rubber, borate glass, polyglycolic acid, polylactic acid, a dehydrated salt, and any combination thereof. Element 10: wherein the uphole extension is received within the push ring and sealingly engages an inner diameter of the push ring. Element 11: wherein a through bore is defined through the setting cone and a projectile seat is provided within the through bore. Element 12: further comprising an element backup ring coupled to the sealing element and made of a dissolvable material. Element 13: further comprising a downhole ramped surface defined by the push ring and engageable with the sealing element to urge the sealing element radially outward and toward the inner surface of the casing, and a beveled edge defined by the uphole shoulder to receive and redirect a portion of the sealing element into a radial gap defined between the uphole shoulder and the inner surface of the casing. Element 14: further comprising a guide shoe arranged at a downhole end of the bridge plug and engageable with the slip ring, and a setting tool attachable to the bridge plug to run the bridge plug into the casing, the setting tool including an inner adapter extending through the setting cone and releasably coupled to the guide shoe, and a setting tool sleeve arranged about the inner adapter and engageable against the push ring to force the push ring into engagement with the setting cone and the sealing element. Element 15: wherein the inner adapter is coupled to the guide shoe at a shearable interface that fails upon assuming a predetermined axial load.

Element 16: wherein the uphole extension is received within the push ring, the method further comprising sealingly engaging an inner diameter of the push ring with the uphole extension. Element 17: wherein the push ring defines a downhole ramped surface and the uphole shoulder defines a beveled edge, the method further comprising engaging the downhole ramped surface against the sealing element and thereby urging the sealing element radially outward and toward the inner surface of the casing, and receiving and redirecting a portion of the sealing element into a radial gap defined between the uphole shoulder and the inner surface of the casing with the beveled edge of the uphole shoulder.

By way of non-limiting example, exemplary combinations applicable to A, B, and C include: Element 3 with Element 4; Element 6 with Element 7; Element 6 with Element 7; and Element 14 with Element 15.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A bridge plug, comprising:

a mandrel;

a setting cone disposed at least partially about the mandrel;

a slip ring and a sealing element disposed at least partially about the setting cone;

a guide shoe operatively coupled to a downhole end of the mandrel; and one or more slip pins extending axially from the guide shoe and received within a corresponding one or more slots defined in the slip ring, wherein the bridge plug is actuatable from a run-in state to a deployed state, and wherein, when the bridge plug is in the deployed state, the mandrel is axially movable relative to the setting cone to seal or open a flow path through the bridge plug.

2. The bridge plug of claim 1, wherein at least one of the mandrel, the setting cone, the slip ring, the sealing element, and the guide shoe is made of a dissolvable material selected from the group consisting of a dissolvable metal, a galvanically-corrodible metals, a degradable polymer, a degradable rubber, borate glass, polyglycolic acid, polylactic acid, a dehydrated salt, and any combination thereof.

3. The bridge plug of claim 1, wherein the mandrel is axially movable between a first position, where fluid flow through the bridge plug in a downhole direction is prevented, and a second position, where fluid flow through the bridge plug in an uphole direction is permitted.

4. The bridge plug of claim 3, wherein an angled outer surface is defined on the mandrel and an angled inner surface is defined on the setting cone, and wherein, when the bridge plug is in the first position, the angled outer surface sealingly engages against the angled inner surface.

5. The bridge plug of claim 4, further comprising one or more seals arranged at the interface of the angled outer and inner surfaces to generate a sealed interface.

6. The bridge plug of claim 3, wherein the mandrel defines a through bore extending only partially through the mandrel, and further defines one or more ports that fluidly communicate with the through bore, and wherein, when the mandrel is in the second position, the angled outer and inner surfaces are separated and fluid flow through the bridge plug in the uphole direction is through the through bore and the one or more ports.

7. The bridge plug of claim 1, wherein a through bore is defined along an entire length of the mandrel, and the mandrel defines a projectile seat sized to receive a wellbore projectile that occludes the through bore.

8. The bridge plug of claim 7, further comprising a cage provided on an uphole end of the mandrel, wherein the wellbore projectile is captured within the cage.

9. The bridge plug of claim 1, further comprising a tooth profile defined on an outer surface of the slip ring, wherein the tooth profile includes one or more slip buttons secured within a corresponding pocket and each slip button is secured within the corresponding pocket with a dissolvable binder material.

10. The bridge plug of claim 9, wherein at least one of the one or more slip buttons is made with a material combined with a dissolvable binder material.

11. The bridge plug of claim 1, wherein a series of ridges is defined on an outer conical surface of the setting cone, and wherein, when the bridge plug is in the deployed state, the series of ridges are forced under the sealing element.

12. The bridge plug of claim 1, wherein the guide shoe is operatively coupled to the downhole end of the mandrel at a shearable interface.

13. The bridge plug of claim 1, further comprising an interference member positioned at a downhole end of the guide shoe and extending partially into the flow path.

14. A method of operating a bridge plug, comprising:

conveying the bridge plug downhole as coupled to a setting tool, the bridge plug including:

a mandrel;

a setting cone disposed at least partially about the mandrel;

a slip ring and a sealing element disposed at least partially about the setting cone;

a guide shoe operatively coupled to a downhole end of the mandrel; and one or more slip pins extending axially from the guide shoe and received within a corresponding one or more slots defined in the slip ring;

actuating the setting tool and thereby transitioning the bridge plug from a run-in state to a deployed state; and with the bridge plug in the deployed state, axially moving the mandrel relative to the setting cone between a first position, where a flow path through the bridge plug is sealed and prevents fluid flow through the bridge plug in a downhole direction, and a second position, where fluid flow through the bridge plug in an uphole direction is permitted.

15. The method of claim 14, further comprising:

axially moving the mandrel to the first position by urging an angled outer surface defined on the mandrel against an angled inner surface defined on the setting cone and thereby generating a sealed interface; and axially moving the mandrel to the second position by separating the angled and outer surfaces and thereby allowing the fluid flow through the bridge plug in the uphole direction.

16. The method of claim 15, wherein the mandrel defines a through bore extending only partially through the mandrel, and further defines one or more ports that fluidly communicate with the through bore, the method further comprising flowing a fluid through the bridge plug in the uphole direction by flowing the fluid through the through bore and the one or more ports.

17. The method of claim 14, wherein a through bore is defined along an entire length of the mandrel, and an uphole end of the mandrel defines a projectile seat, the method further comprising:

receiving a wellbore projectile at the projectile seat and thereby occluding the through bore; and increasing a fluid pressure uphole from the bridge plug and thereby transitioning the bridge plug to the first position.

18. The method of claim 14, wherein a series of ridges is defined on an outer conical surface of the setting cone, and wherein transitioning the bridge plug from the run-in state to the deployed state further comprises forcing the series of ridges under the sealing element.

19. The method of claim 14, wherein the guide shoe is operatively coupled to the downhole end of the mandrel at a shearable interface, and wherein actuating the setting tool further comprises shearing the shearable interface and thereby separating the mandrel from the guide shoe.

* * * * *